US007177554B2

(12) United States Patent
Van Vliembergen

(10) Patent No.: US 7,177,554 B2
(45) Date of Patent: Feb. 13, 2007

(54) PRINTER AS WELL AS A METHOD FOR CONTROLLING SUCH A PRINTER

(75) Inventor: Eduardus J. W. Van Vliembergen, AX Venlo (NL)

(73) Assignee: Oce-Technologies B.V., Venlo (NL)

( * ) Notice: Subject to any disclaimer, the term of this patent is extended or adjusted under 35 U.S.C. 154(b) by 230 days.

(21) Appl. No.: 11/012,134

(22) Filed: Dec. 16, 2004

(65) Prior Publication Data

US 2005/0135860 A1 Jun. 23, 2005

(30) Foreign Application Priority Data

Dec. 19, 2003 (EP) ..... 03079005

(51) Int. Cl.
*G03G 15/00* (2006.01)
*B65H 3/44* (2006.01)

(52) U.S. Cl. ..... 399/23; 399/391; 271/9.01; 271/9.03

(58) Field of Classification Search ..... 399/23, 399/16, 85, 391, 393; 271/9.01, 9.03, 9.04, 271/9.05, 265.01; 400/624
See application file for complete search history.

(56) References Cited

U.S. PATENT DOCUMENTS 4,763,889 A 8/1988 Dei et al.
4,885,613 A 12/1989 Kudoh
5,301,936 A 4/1994 Matsumoto
6,526,253 B2 * 2/2003 Hayashi et al. ..... 399/391

FOREIGN PATENT DOCUMENTS

JP 60188245 A * 9/1985
JP 61169430 A * 7/1986

OTHER PUBLICATIONS

Patent Abstracts of Japan, vol. 0103, No. 15 (M-529), Oct. 25, 1986 & JP-61-124448-A, Jun. 12, 1986.
Patent Abstracts of Japan, vol. 0070, No. 10 (P-168), Jan. 14, 1983, and JP-57-167042-A, Oct. 14, 1982.

* cited by examiner

*Primary Examiner*—Leslie J. Evanisko
(74) *Attorney, Agent, or Firm*—Birch, Stewart, Kolasch & Birch, LLP

(57) ABSTRACT

A printer for printing on a receiving medium of a predetermined type, including a plurality of feeders for holding receiving media and a control unit, wherein the control unit contains determining means for determining that at least two feeders of the said plurality of feeders hold receiving medium of the predetermined type, means for determining the amount of receiving medium which can be added to each of the two feeders up to a predetermined maximum amount for these feeders, and means for selecting the feeder to which the largest amount receiving medium can be added for feeding a receiving medium to the printing unit.

6 Claims, 2 Drawing Sheets

PRINTER AS WELL AS A METHOD FOR CONTROLLING SUCH A PRINTER

This Nonprovisional application claims priority under 35 U.S.C. § 119(a) on Patent Application No(s). 03079005.9 filed in Europe on Dec. 19, 2003, the entire contents of which are hereby incorporated by reference.

BACKGROUND OF THE INVENTION

The present invention relates to a printer comprising a printing unit for printing on a receiving medium of a predetermined type, a plurality of feeders for holding receiving media, and means for establishing the type of receiving medium held by each of the feeders.

The present invention furthermore relates to a method for printing a receiving medium of a predetermined type using a printer having a printing unit and a plurality of feeders for holding the receiving media, the method including the establishment of the type of receiving medium to be held by each of the said feeders.

The printer, which is known from U.S. Pat. No. 4,885,613 includes a plurality of feeders with the same receiving medium in the form of a roll or sheets wherein the feeder is selected from the largest amount of recording medium remaining therein. In such a printer, a nearly empty feeder will only be fully emptied if the other feeders holding the same type of receiving medium have been also emptied. Thus, a printer will almost never contain an empty feeder in which another type of receiving medium, for example receiving sheets having another format, another color or another thickness can be inserted. The feeders will be used successively since after using one feeder, the amount of receiving sheets remaining therein will be less than the amount of receiving sheets in another feeder so that said other feeder with the larger amount of receiving sheets will be selected by the control unit. For example, in the case where there are four feeders containing the same type of receiving sheets, all four feeders will be used successively and become empty at almost the same moment. At that moment the operator needs to replenish all feeders at the same time. By using the feeders successively, many feeder changes, involving relatively elaborate operator handling, will occur.

SUMMARY OF THE INVENTION

It is an object of the present invention to provide a printer whereby the feeders will be used in a more optimised manner.

This object is achieved by utilizing a printer containing a means for determining for at least two feeders holding a predetermined type of receiving material, the amount of receiving medium which can be added to each of these feeders up to a predetermined maximum amount, and means for selecting the feeder to which the largest amount of receiving medium can be added for feeding the receiving medium to the printing unit.

By utilizing receiving sheets from the feeder to which the largest amount of receiving medium can be added, this feeder will be fully emptied before another feeder will be selected. In this manner, only a relatively small number of feeder changes will occur. Since the feeder which is being selected will be fully emptied before another feeder will be selected, the feeder will become available for using another type of receiving medium, if necessary. Furthermore, if an operator wants to replenish the feeders, he can add a relatively large amount of receiving sheets to the feeder which is at that moment being selected by the control unit as the feeder for feeding receiving sheets to the printing unit.

The printer, according to the present invention, gives the operator substantial freedom to decide when he wants to replenish the feeders and which feeders he wants to replenish.

In one embodiment of the printer according to the present invention, the feeder closest to the printing unit is selected, for example by a control unit, in the case where there are more feeders to which the same largest amount of receiving medium can be added. By selecting the feeder closest to the printing unit, the printer will be able to print relatively fast on the receiving medium. In the case where there are more feeders at the same distance from the printing unit, the lowest feeder is preferably selected.

In another embodiment of the printer according to the present invention, the feeder which has the smallest amount of receiving medium therein is selected, for example by the control unit, in the case where there are more feeders having the same largest amount of receiving medium which can be added. By utilizing feeders having different predetermined maximum amounts, the feeder which has the smallest amount of receiving medium left therein will be selected. This feeder will thus be emptied relatively quickly so that it becomes available for other types of receiving medium.

In yet another embodiment of the printer according to the present invention, the printer includes a level detector means for determining the amount of receiving medium available in the feeders, and also includes subtraction means for subtracting the available amount from a predetermined maximum amount to obtain the amount of receiving medium which can be added to each feeder. In this manner the amount of receiving medium that can be added to each feeder can be determined in a relatively easy manner.

In a further embodiment of the printer according to the present invention, the printer contains means for measuring the distance between a first level at which the feeder is filled with receiving medium up to the predetermined maximum amount and a second level up to which said feeder is actually filled with receiving medium. By measuring this distance, the amount of receiving medium which can be added can be determined relatively easily.

The amount of receiving medium which can be added to each feeder can be determined relatively accurately or relatively rough in which latter case, there will be established a kind of threshold. For example, the amount of sheets can be determined by using increments equal to 100. In the latter case for example, the amount of sheets that can be added is determined as zero sheets, 100–200 sheets, 200–300 sheets etc.

The present invention also relates to a method for printing a receiving medium of a predetermined type using a printer having a printing unit and a plurality of feeders for holding receiving media, the method including the steps of establishing the type of receiving medium held by each of the feeders, and, if the predetermined type of receiving material is held by at least two feeders, determining the amount of receiving medium which can be added to each of the said at least two feeders up to a predetermined maximum amount, and selecting the feeder to which the largest amount of receiving medium can be added for feeding the receiving sheet to the printing unit. By following this method, a once chosen feeder will be fully emptied before another feeder will be selected unless another empty feeder will be refilled with a very small amount of paper, in the case of which this feeder will be selected. In this manner feeders will be emptied relatively quickly and become available for other types of receiving media. Furthermore an operator will have a relatively large freedom by replenishing the feeders.

BRIEF DESCRIPTION OF THE DRAWINGS

The present invention will further be explained with reference to the drawings wherein, FIG. 1 schematically shows a set of feeders of a printer according to the present invention.

DETAILED DESCRIPTION OF THE INVENTION

Figure 1:
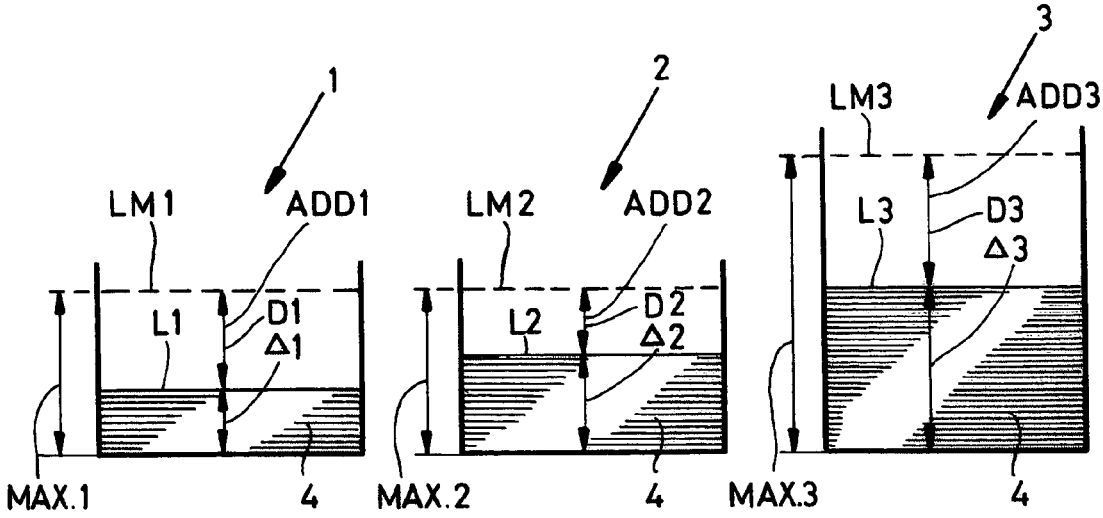

FIG. 1 shows a part of a known printer containing a printing unit (not shown), a plurality of feeders 1, 2, 3 for feeding receiving sheets 4 to the printing unit and a control unit (not shown) for controlling the printing process. The printer may include a large number of feeders of which only three feeders are being shown. In the three feeders, the same type of receiving sheets, for example sheets with an A4-format, 80 grams, and white color are available. In the present embodiment, this is established automatically by the printer by using art known sensing means for sensing the type of receiving material. In another embodiment, the type of receiving material is programmed by the operator and stored in a memory, for example the memory of a control unit of the printer. In feeder 1 a predetermined maximum amount of receiving sheets 4 is MAX1, the predetermined maximum amount of feeder 2 is MAX2 and the predetermined maximum amount of feeder 3 is MAX 3. The maximum amount for feeders 1, 2 is the same so that MAX1=MAX2, whereby MAX1 is for example 1000 sheets. The predetermined maximum amount MAX3 of feeder 3 is larger than the maximum amounts MAX1, MAX2 and is for example 3000 sheets.

Figure 2:
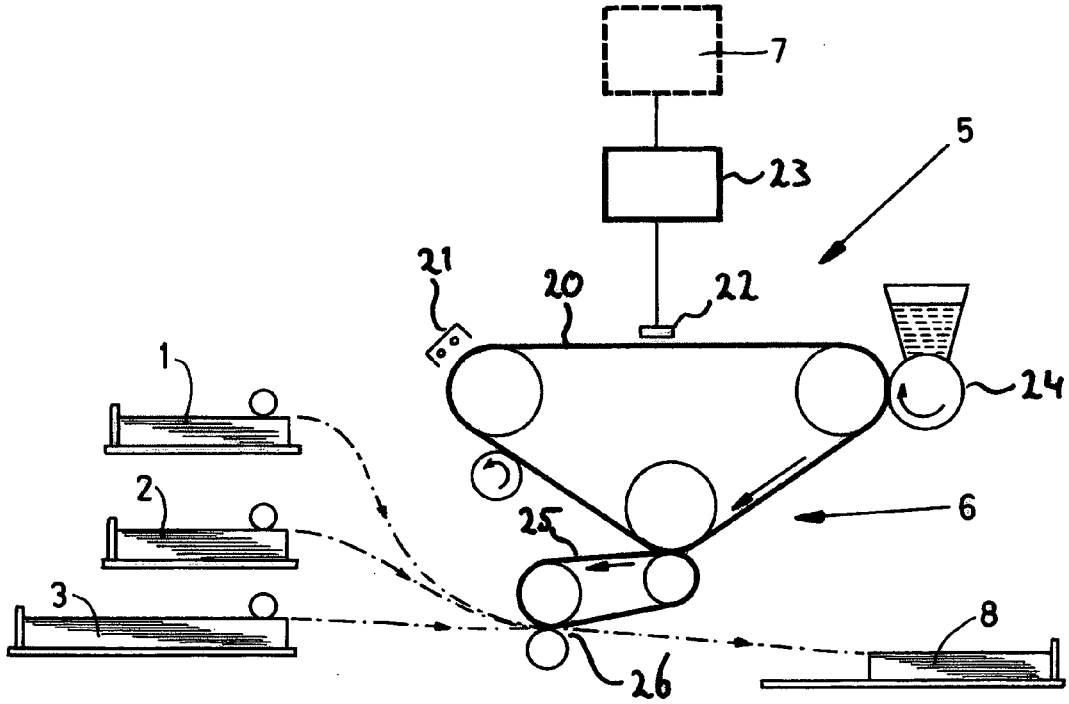
FIG. 2 shows a printer according to the present invention.

FIG. 2 shows a printer 5 utilizing the three feeders as shown in FIG. 1, a printing unit 6, a control unit 7 for controlling the printer 5 as well as a tray 8 in which sheets on which information is printed by printing unit 6 can be stored. Although depicted as one single unit 7, it is clear that the control unit may also consist of several subunits distributed over the printer. Other parts of the printing unit 6 are the imaging belt 20, charging station 21, printhead 22 with control unit 23, developing station 24, intermediate transfer belt 25 and transfer nip 26. Such a printer is described in greater detail in European patent application EP 0 599 374 the subject matter of which is hereby incorporated by reference.

The printer 5 includes sensing means (not shown) for each feeder 1, 2, 3 provided with level detector means for determining the amount of receiving sheets Δ1, Δ2, Δ3 available in each feeder 1, 2, 3. The sensing means furthermore comprise subtracting means for subtracting the available amount Δ1, Δ2, Δ3 from the predetermined maximum amount MAX1, MAX2, MAX3 to obtain the amount ADD1, ADD2, ADD3 of receiving sheets which can be added to each feeder 1, 2, 3.

The feeder 1 comprises, for example, an amount Δ1 of 300 receiving sheets 4 so that ADD1 is 1000−300=700. In feeder 2 the available amount Δ2 is 600 so that ADD2 is 1000−600=400. In feeder 3 the available amount Δ3 is 1600 so that ADD3 is 3000−1600=1400. It is not absolutely necessary to determine the exact amount of receiving sheets 4 but a rough estimation rounded up to hundreds might work as well.

By using the control unit it can now be determined to which feeder the largest amount of receiving sheets can be added. By the example given above, the feeder 3 will be selected since ADD3 (1400) is larger than ADD2 (400) and ADD1 (700). By selecting feeder 3, several printing processes can be done until feeder 3 is fully emptied. By the control unit it will then be decided to use feeder 1 since ADD1 with 700 sheets is larger than ADD2 with 400 sheets. An operator can be informed of the available amount Δ1, Δ2, Δ3 and/or the amount ADD1, ADD2, ADD3 of receiving sheets which can be added to each feeder, by means of a display (not shown) or by an indicator means (not shown) on each feeder 1, 2, 3 or by opening each feeder 1, 2, 3. The operator can then replenish the feeder 3 with a relatively large amount of receiving sheets. After replenishing the empty feeder 3, the control unit will continue by emptying feeder 1. After feeder 1 is emptied, the control unit will select feeder 2 since after emptying feeder 1 and replenishing feeder 3 up to the maximum amount MAX3, feeder 2 has the largest amount ADD2 of receiving sheets which can be added. The operator can replenish feeder 1 before feeder 2 is fully emptied or can replenish both feeders 1 and 2 after the feeder 2 is also emptied. Preferably a feeder 1, 2, 3 is not replenished while a feeder 1, 2, 3 is being used as a feeder for feeding a receiving sheet to the printing unit, to prevent disruption of the printing process. If a feeder is opened, another feeder will be selected temporarily.

Instead of determining the amount Δ1, Δ2, Δ3, it is also possible to provide the printer with sensing means for measuring between a first level LM1, LM2, LM3 at which the feeder 1, 2, 3 is filled with receiving sheets 4 up to the predetermined maximum amount MAX1, MAX2, MAX3 and a second level L1, L2, L3 up to which said feeder 1, 2, 3 is actually filled with receiving sheet 4. The distance D1, D2, D3 is a measure of the amount of receiving sheets which can be added, whereby the largest distance, in this example D3, corresponds with the largest amount of receiving sheets which can be added.

Figure 3:
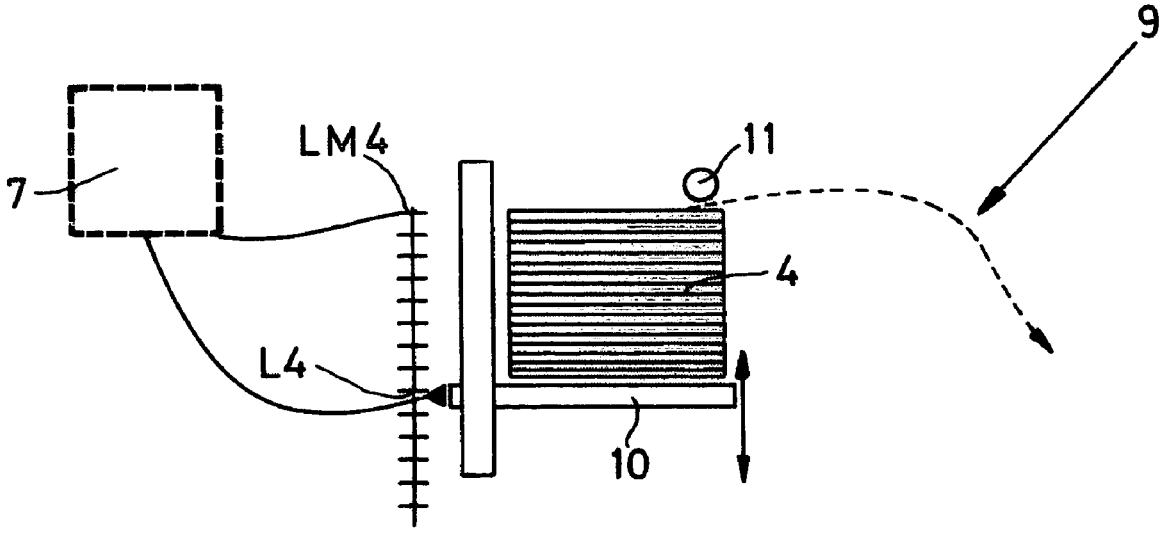
FIG. 3 schematically shows a feeder comprising sensing means according to the invention.

FIG. 3 shows another kind of feeder 9 in which the stack of receiving sheets 4 is located on a platform 10 which is movable under a spring force in an upward direction until the upper sheet 4 is located against a transport roller 11. The level L4 of the platform 10 is determined by means of the control unit 7 in which also the maximum level LM4 of the platform 10 is also being stored. The difference between the maximum level LM4 and L4 provides the control unit 7 with information about the actual amount of receiving sheets in the feeder 9 while the level L4 is a direct measure of the amount of receiving sheets which can be added to the feeder 9.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a printing unit for printing on a receiving medium of a predetermined type, a plurality of feeders for holding receiving media, and means for establishing the type of receiving medium held by each of the said feeders, wherein the printer includes means for determining, upon establishing that at least two feeders hold the predetermined type of receiving medium, the amount of receiving medium which can be added to each of these at least two feeders up to a predetermined maximum amount, and selecting means for selecting the feeder to which the largest amount of receiving medium can be added, for feeding the receiving medium to the printing unit.

2. The printer according to claim 1, wherein the feeder closest to the printing unit is selected, in the case where there are a plurality of feeders to which the same, largest amount of receiving medium can be added.

3. The printer according to claim 1, wherein the feeder which has the smallest amount of receiving medium therein is selected in the case where there are a plurality of feeders having the same largest amount of receiving medium which can be added.

4. The printer according to claim 1 containing a level detector means for determining the amount of receiving medium available in the feeders, and subtraction means for subtracting the available amount from a predetermined maximum amount to obtain the amount of receiving medium which can be added to each feeder.

5. The printer according to claim 1 containing means for measuring the distance between a first level at which the feeder is filled with receiving medium up to the predetermined maximum amount and a second level up to which said feeder is actually filled with receiving medium.

6. A method for printing a receiving medium of a predetermined type using a printer having a printing unit and a plurality of feeders for holding receiving media, which comprises:

establishing the type of receiving medium held by each of the feeders and if said predetermined type of receiving material is held by at least two feeders, determining the amount of receiving medium which can be added to each of said feeders up to a predetermined maximum amount, and selecting the feeder to which the largest amount of receiving medium can be added for feeding the receiving medium to the printing unit.

* * * * *